US010282955B2

(12) United States Patent
Linn et al.

(10) Patent No.: US 10,282,955 B2
(45) Date of Patent: May 7, 2019

(54) FOREST FIRE FUEL HEAT TRANSFER SENSOR

(71) Applicant: The United States of America as Represented by the Secretary of Agriculture, Washington, DC (US)

(72) Inventors: Rodman Linn, Los Alamos, NM (US); Scott Goodrick, Athens, GA (US); Joseph John O'Brien, Athens, GA (US)

( * ) Notice: Subject to any disclaimer, the term of this patent is extended or adjusted under 35 U.S.C. 154(b) by 0 days.

(21) Appl. No.: 15/598,599

(22) Filed: May 18, 2017

(65) Prior Publication Data

US 2018/0336771 A1 Nov. 22, 2018

(51) Int. Cl.

| | |
|---|---|
| ***G08B 17/00*** | (2006.01) |
| ***G08B 17/12*** | (2006.01) |
| ***G08B 17/08*** | (2006.01) |
| ***A62C 3/02*** | (2006.01) |

(52) U.S. Cl.

CPC ..... *G08B 17/005* (2013.01); *A62C 3/0271* (2013.01); *G08B 17/08* (2013.01); *G08B 17/12* (2013.01); *F23N 2029/10* (2013.01); *F23N 2029/16* (2013.01)

(58) Field of Classification Search

None

See application file for complete search history.

(56) References Cited

U.S. PATENT DOCUMENTS

| | | | | |
|---|---|---|---|---|
| 5,954,430 | A * | 9/1999 | Turtiainen | G01K 1/20 374/126 |
| 2005/0053117 | A1* | 3/2005 | O'Neill | G01K 1/20 374/121 |
| 2005/0058179 | A1* | 3/2005 | Phipps | G01K 1/08 374/208 |
| 2006/0193369 | A1* | 8/2006 | O'Neill | G01K 1/20 374/109 |
| 2016/0109301 | A1* | 4/2016 | Thompson | G01K 7/02 374/179 |

OTHER PUBLICATIONS

"Heat Transfer," Biology Cabinet, Apr. 25, 2009, http://www.biocab.org/Heat_Transfer.html.*

(Continued)

*Primary Examiner* — Laura N Nguyen

(57) ABSTRACT

A heat transfer sensor includes a support body, a first thermocouple probe, a second thermocouple probe, and a third thermocouple probe. Each thermocouple probe is mounted to the support body and includes a hollow cylinder, a thermocouple, and an insulator. The thermocouple is mounted to an interior of the associated hollow cylinder and is configured to generate a first voltage based on a temperature of the associated hollow cylinder. The insulator is mounted between the associated hollow cylinder and the top wall. The first hollow cylinder has an emissivity ≤0.25. The second hollow cylinder has an emissivity ≥0.75. The third thermocouple probe has an emissivity that is >0.25 and <0.75 or measures a temperature of an environment surrounding the support body. A convective heat transfer and an incident radiation are computed using the first and second voltage and either the third voltage or the air temperature.

18 Claims, 6 Drawing Sheets

(56) References Cited

OTHER PUBLICATIONS

"Understanding Radiation Heat Transfer," Qpedia, vol. 1 Issue 3, Apr. 2007, obtained from <https://www.qats.com/Qpedia-Thermal-eMagazine/Back-Issues-Content/40.aspx>.*
"Radiation Heat Transfer," The Engineering Toolbox, 2003, available at: https://www.engineeringtoolbox.com/radiation-heat-transfer-d_431.html, accessed Oct. 15, 2018.*

* cited by examiner

FOREST FIRE FUEL HEAT TRANSFER SENSOR

REFERENCE TO GOVERNMENT RIGHTS

This invention was made with government support. The government has certain rights in the invention.

BACKGROUND

Fire management and fire protection in the context of wildland fire depends on the capability to predict the processes by which unburned fuel is ignited. The two primary ways of heating wildland fuel are through convective and radiative heat transfer. Discerning the relative contributions of these two heat transfer modes is critical for an understanding of how to manage wildland fire as well as predict its behavior.

SUMMARY

In an example embodiment, a heat transfer sensor is provided. The heat transfer sensor includes, but is not limited to, a support body, a first thermocouple probe, a second thermocouple probe, a third thermocouple probe, a processor, and a non-transitory computer-readable medium operably coupled to the processor. The support body includes, but is not limited to, a top wall and a plurality of side walls.

The first thermocouple probe is mounted to the top wall to extend upright relative to an exterior surface of the top wall. The first thermocouple probe includes, but is not limited to, a first hollow cylinder, a first thermocouple, and a first insulator. The first hollow cylinder is configured to have a first emissivity that is less than or equal to 0.25. The first thermocouple is mounted to an interior of the first hollow cylinder and is configured to generate a first voltage based on a first temperature of the first hollow cylinder. The first insulator is mounted between the first hollow cylinder and the top wall.

The second thermocouple probe is mounted to the top wall to extend upright relative to the exterior surface of the top wall. The second thermocouple probe includes, but is not limited to, a second hollow cylinder, a second thermocouple, and a second insulator. The second hollow cylinder is configured to have a second emissivity that is greater than or equal to 0.75. The second thermocouple is mounted to an interior of the second hollow cylinder and is configured to generate a second voltage based on a second temperature of the second hollow cylinder. The second insulator is mounted between the second hollow cylinder and the top wall.

The third thermocouple probe is mounted to the top wall to extend upright relative to the exterior surface of the top wall. The third thermocouple probe includes, but is not limited to, a third hollow cylinder, a third thermocouple, and a third insulator. The third hollow cylinder is configured to have a third emissivity that is greater than 0.25 and less than 0.75. The third thermocouple is mounted to an interior of the third hollow cylinder and is configured to generate a third voltage based on a third temperature of the third hollow cylinder. The third insulator is mounted between the third hollow cylinder and the top wall.

The computer-readable medium has computer-readable instructions stored thereon that, when executed by the processor, cause the heat transfer sensor to receive the first voltage from the first thermocouple probe, to receive the second voltage from the second thermocouple probe, to receive the third voltage from the third thermocouple probe, and to store the received first voltage, the received second voltage, and the received third voltage for computation of a convective heat transfer and an incident radiation of an environment surrounding the support body. The received first voltage is converted to a first temperature value. The received second voltage is converted to a second temperature value. The received third voltage is converted to a third temperature value.

In another example embodiment, a heat transfer sensor is provided. The heat transfer sensor includes, but is not limited to, a support body, a first thermocouple probe, a second thermocouple probe, a third thermocouple probe, a processor, and a non-transitory computer-readable medium operably coupled to the processor. The support body includes, but is not limited to, a top wall and a plurality of side walls.

The first thermocouple probe is mounted to the top wall to extend upright relative to an exterior surface of the top wall. The first thermocouple probe includes, but is not limited to, a first hollow cylinder, a first thermocouple, and a first insulator. The first hollow cylinder is configured to have a first emissivity that is less than or equal to 0.25. The first thermocouple is mounted to an interior of the first hollow cylinder and is configured to generate a first voltage based on a first temperature of the first hollow cylinder. The first insulator is mounted between the first hollow cylinder and the top wall.

The second thermocouple probe is mounted to the top wall to extend upright relative to the exterior surface of the top wall. The second thermocouple probe includes, but is not limited to, a second hollow cylinder, a second thermocouple, and a second insulator. The second hollow cylinder is configured to have a second emissivity that is greater than or equal to 0.75. The second thermocouple is mounted to an interior of the second hollow cylinder and is configured to generate a second voltage based on a second temperature of the second hollow cylinder. The second insulator is mounted between the second hollow cylinder and the top wall.

The third thermocouple probe is mounted to the top wall to measure an air temperature of an environment surrounding the support body.

The computer-readable medium has computer-readable instructions stored thereon that, when executed by the processor, cause the heat transfer sensor to receive the first voltage from the first thermocouple probe, to receive the second voltage from the second thermocouple probe, to receive the air temperature from the third thermocouple probe, and to store the received first voltage, the received second voltage, and the received air temperature for computation of a convective heat transfer and an incident radiation of an environment surrounding the support body. The received first voltage is converted to a first temperature value. The received second voltage is converted to a second temperature value.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
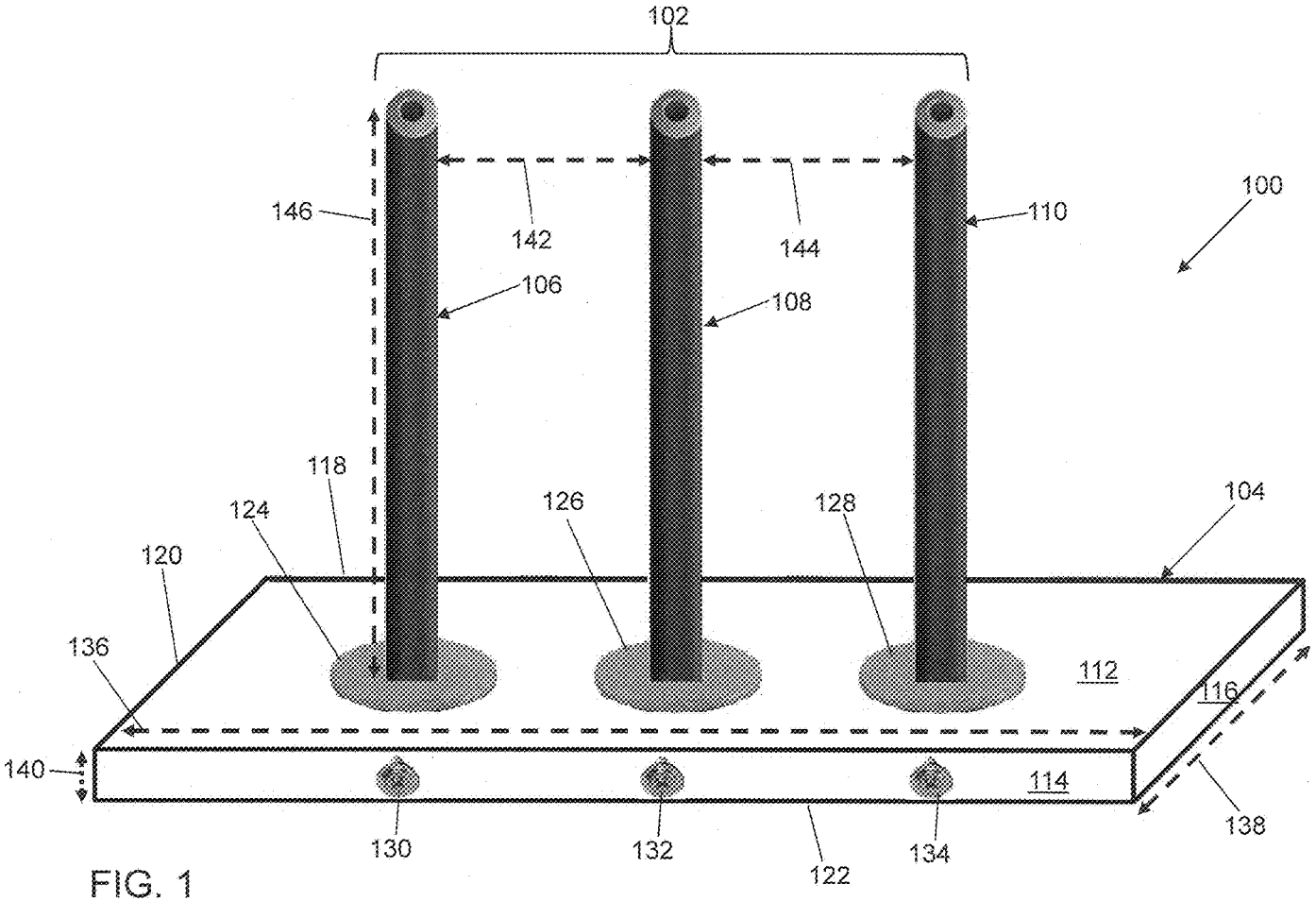
FIG. 1 depicts a front, perspective view of a heat transfer sensor in accordance with an illustrative embodiment.
Figure 2:
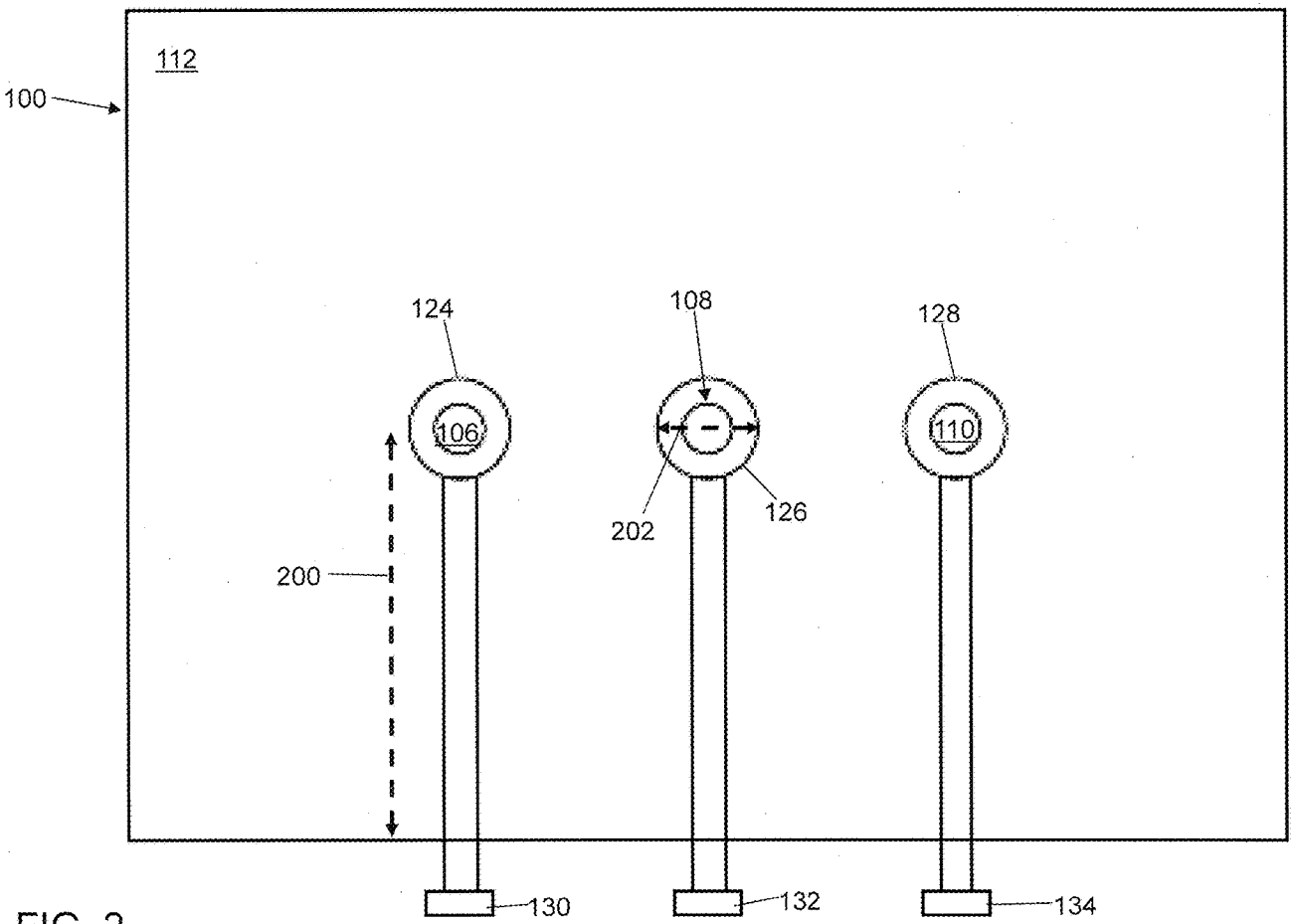
FIG. 2 depicts a top view of the heat transfer sensor of FIG. 1 in accordance with an illustrative embodiment.
Figure 3:
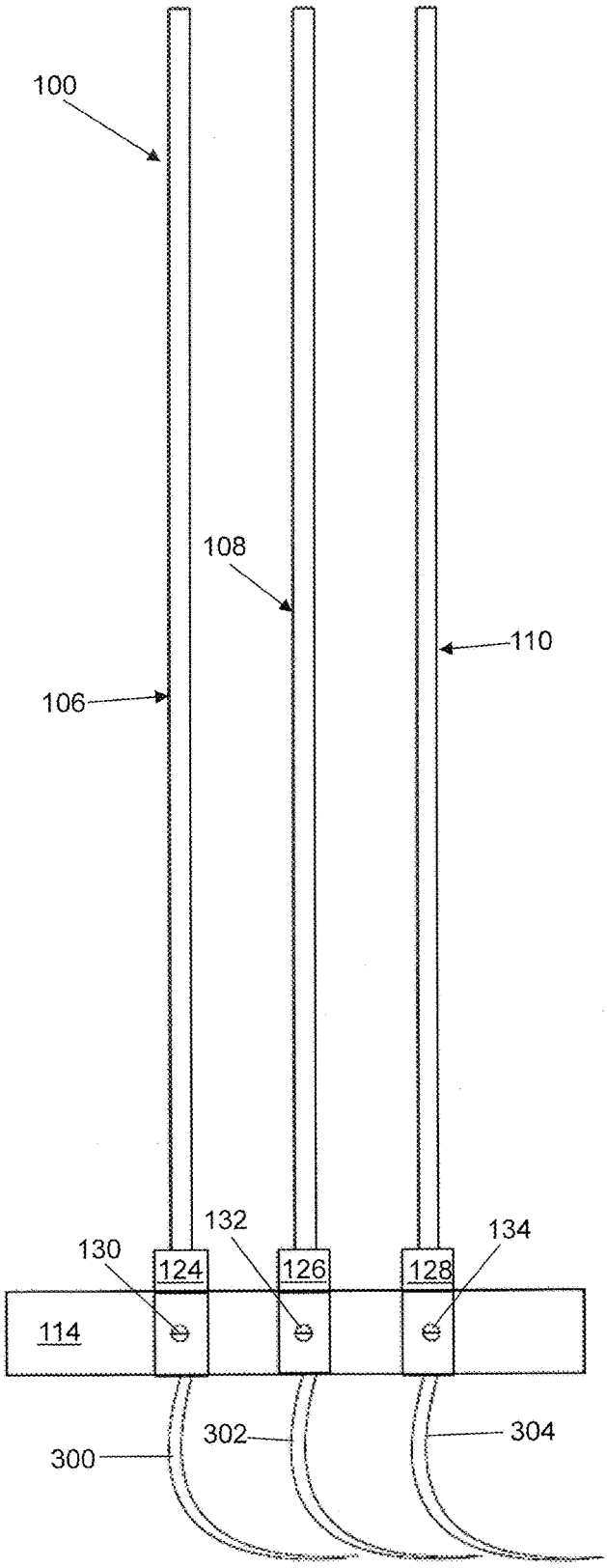
FIG. 3 depicts front view of the heat transfer sensor of FIG. 1 in accordance with an illustrative embodiment.

With reference to FIG. 1, a front, perspective view of a heat transfer sensor 100 is shown in accordance with an illustrative embodiment. With reference to FIG. 2, a top view of heat transfer sensor 100 is shown in accordance with an illustrative embodiment. With reference to FIG. 3, a front view of heat transfer sensor 100 is shown in accordance with an illustrative embodiment. Heat transfer sensor 100 may include a plurality of thermocouple probes 102 and a support body 104. The plurality of thermocouple probes 102 may include a first thermocouple probe 106, a second thermocouple probe 108, and a third thermocouple probe 110. Support body 104 may include a top wall 112, a front wall 114, a left wall 116, a back wall 118, a right wall 120, and a bottom wall 122. Top wall 112, front wall 114, left wall 116, back wall 118, right wall 120, and bottom wall 122 may be formed of a variety of materials such as various metals that can withstand temperatures up to 2,200 degrees Fahrenheit (F).

First thermocouple probe 106 is mounted through top wall 112. A first insulator 124 surrounds a portion of first thermocouple probe 106 adjacent top wall 112 and insulates first thermocouple probe 106 from top wall 112. Second thermocouple probe 108 is mounted through top wall 112. A second insulator 126 surrounds a portion of second thermocouple probe 108 adjacent top wall 112 and insulates second thermocouple probe 108 from top wall 112. Third thermocouple probe 110 is mounted through top wall 112. A third insulator 128 surrounds a portion of third thermocouple probe 110 adjacent top wall 112 and insulates third thermocouple probe 110 from top wall 112. First thermocouple probe 106, second thermocouple probe 108, and third thermocouple probe 110 may be formed of a hollow cylinder or a thin wire that is formed of a variety of materials such as various metals that can withstand temperatures up to 2,200 degrees F.

Use of directional terms, such as top, bottom, right, left, front, back, etc. are merely intended to facilitate reference to the various surfaces and elements of the described structures relative to the orientations shown in the drawings and are not intended to be limiting in any manner.

As used in this disclosure, the term "mount" includes join, unite, connect, couple, associate, insert, hang, hold, affix, attach, fasten, bind, paste, secure, bolt, screw, rivet, solder, weld, glue, adhere, form over, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

First thermocouple probe 106, second thermocouple probe 108, and third thermocouple probe 110 may extend a thermocouple probe height 146 above top wall 112. First thermocouple probe 106, second thermocouple probe 108, and third thermocouple probe 110 may be positioned a thermocouple probe setback distance 200 (shown referring to FIG. 2) from front wall 114. Merely for illustration, thermocouple probe height 146 may be 300 millimeters (mm), and thermocouple probe setback distance 200 may be 50 mm.

First insulator 124, second insulator 126, and third insulator 128 may have an insulator diameter 202. Merely for illustration, insulator diameter 202 may be 12 mm.

Figure 4:
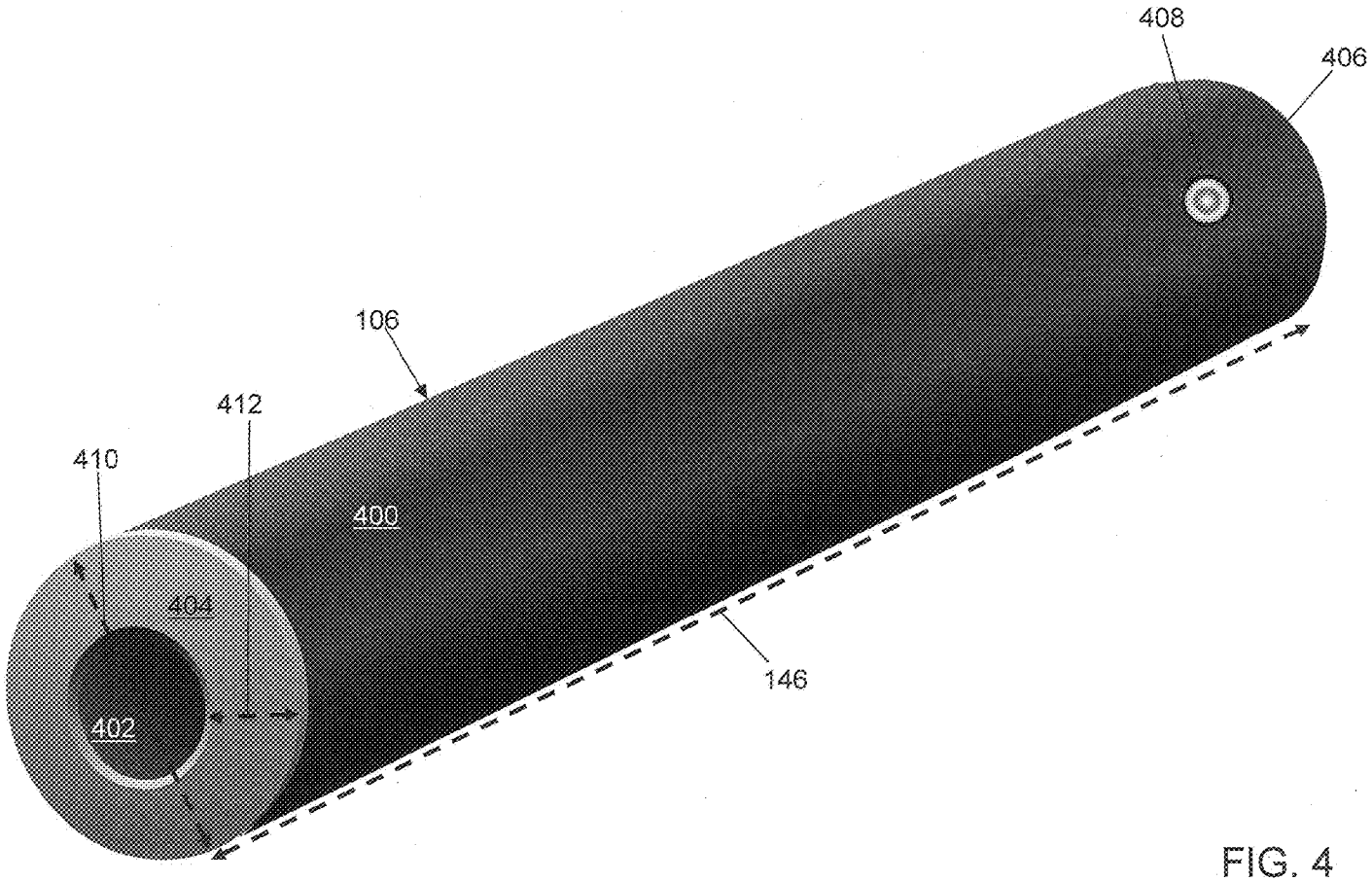
FIG. 4 depicts a top, perspective view of a thermocouple probe of the heat transfer sensor of FIG. 1 in accordance with an illustrative embodiment.

Referring to FIG. 4, first thermocouple probe 106, second thermocouple probe 108, and third thermocouple probe 110 may have similar dimensions and may each include a thermocouple probe outer surface 400, a thermocouple probe interior surface 402, a thermocouple probe top surface 404, a thermocouple probe bottom surface 406, and a set screw aperture wall 408. First thermocouple probe 106, second thermocouple probe 108, and third thermocouple probe 110 may have similar dimensions that include thermocouple probe height 146, a thermocouple probe diameter 410, and a thermocouple probe wall width 412. First thermocouple probe 106, second thermocouple probe 108, and third thermocouple probe 110 may have similar heights, diameters, and wall thicknesses. Merely for illustration, thermocouple probe diameter 410 may be 5 mm, and thermocouple probe wall width 412 may be 0.5 to 1 mm. Thermocouple probe wall width 412 may be selected to be as thin as possible while providing adequate structural integrity.

An area of first thermocouple probe 106, second thermocouple probe 108, and third thermocouple probe 110 computed using thermocouple probe height 146 and thermocouple probe diameter 410 is approximately equal to an area of an object in the environment for which heat transfer sensor 100 computes a convective heat transfer and an incident radiation. For example, illustrative dimensions for first thermocouple probe 106, second thermocouple probe 108, and third thermocouple probe 110 may be selected based on objects of interest that include grasses, twigs, pine needles, etc. (fuel types). Thermocouple probe height 146 does not need to vary to represent the different objects of interest. Instead, thermocouple probe diameter 410 may vary. Thermocouple probe height 146 may be selected such that a base of first thermocouple probe 106, second thermocouple probe 108, and third thermocouple probe 110 adjacent to top wall 112 does not influence the temperature measurement.

A first set screw 130 is mounted through front wall 114 and into first thermocouple probe 106 to hold first thermocouple probe 106 in an upright position of approximately 90 degrees relative to top wall 112. A second set screw 132 is mounted through front wall 114 and into second thermocouple probe 108 to hold second thermocouple probe 108 in an upright position of approximately 90 degrees relative to top wall 112. A third set screw 134 is mounted through front wall 114 and into third thermocouple probe 110 to hold third thermocouple probe 110 in an upright position of approximately 90 degrees relative to top wall 112. Other angles relative to top wall 112 may be used as long as the angle formed by each of first thermocouple probe 106, second thermocouple probe 108, and third thermocouple probe 110 is approximately equal.

One or more thermocouples (not shown) are mounted to an interior surface 402 (shown referring to FIG. 4) of each of first thermocouple probe 106, second thermocouple probe 108, and third thermocouple probe 110 to measure a temperature of each thermocouple probe. As understood by a person of skill in the art, a thermocouple produces a temperature-dependent voltage as a result of a thermoelectric effect. The voltage can be converted to a temperature value. A first thermocouple lead wire 300 is electrically connected to the one or more thermocouples mounted to first thermocouple probe 106. A second thermocouple lead wire 302 is electrically connected to the one or more thermocouples mounted to second thermocouple probe 108. A third thermocouple lead wire 304 is electrically connected to the one or more thermocouples mounted to third thermocouple probe 110.

When a single thermocouple is mounted to any of first thermocouple probe 106, second thermocouple probe 108, or third thermocouple probe 110, the single thermocouple may be mounted near a tip of the respective thermocouple probe 110 that is opposite top wall 112. For illustration, the thermocouple may be mounted a distance that is five times thermocouple probe diameter 410 below the tip of the respective thermocouple probe 110. Any closer to the tip may violate the cylindrical heat transfer model on which the calculations below are based. Preferably, each thermocouple is mounted the same distance below the tip of the respective thermocouple probe 110.

When a plurality of thermocouples is mounted to any of first thermocouple probe 106, second thermocouple probe 108, or third thermocouple probe 110, the plurality of thermocouples may be mounted the distance from the tip of the respective thermocouple probe 110 and at even lower heights relative to the tip. For example, when the plurality of thermocouples includes three thermocouples, a first thermocouple may be mounted to interior surface 402 at approximately thermocouple probe height 146, a second thermocouple may be mounted to interior surface 402 at approximately 200 mm measured vertically relative to top wall 112, and the third thermocouple may be mounted to interior surface 402 at approximately 100 mm measured vertically relative to top wall 112 in an illustrative embodiment. As a result, the plurality of thermocouples may be distributed longitudinally along thermocouple probe height 146 of the associated thermocouple probe.

When thermocouple probe diameter 410 exceeds approximately 25 mm a plurality of thermocouples further may be circumferentially spaced at equal angles relative to a center of a circle circumscribed by interior surface 402. For example, when thermocouple probe diameter 410 exceeds approximately 25 mm, two thermocouples may be placed at each height that are separated by 180 degrees. As another example, when thermocouple probe diameter 410 exceeds approximately 25 mm, three thermocouples may be placed at each height that are separated by 120 degrees. As still another example, when thermocouple probe diameter 410 exceeds approximately 25 mm, six thermocouples may be placed at each height that are separated by 60 degrees. The number of thermocouples placed at each height may be selected to provide an adequate representation of a temperature variation around interior surface 402.

Support body 104 may have a width 136, a depth 138, and a height 140. Width 136, depth 138, and height 140 may be selected to provide sufficient support to maintain first thermocouple probe 106, second thermocouple probe 108, and third thermocouple probe 110 in the upright position. Merely for illustration, width 136 may be selected as approximately 140 mm, depth 138 may be selected as approximately 140 mm, and height 140 may be selected as approximately 20 mm. Though shown in the illustrative embodiment as forming a generally square shape, support body 104 may have any shaped body including other polygons as well as circular or elliptical enclosures.

First thermocouple probe 106 may be separated from second thermocouple probe 108 by a first thermocouple probe separation distance 142. Second thermocouple probe 108 may be separated from third thermocouple probe 110 by a second thermocouple probe separation distance 144. First thermocouple probe separation distance 142 may be equal to second thermocouple probe separation distance 144 though this is not required. First thermocouple probe separation distance 142 and second thermocouple probe separation distance 144 are selected to be close enough to minimize a difference in their respective airflow environments, but not so close that an airflow around one thermocouple probe interferes with the airflow around the adjacent thermocouple probe. For example, a minimum spacing value for first thermocouple probe separation distance 142 and second thermocouple probe separation distance 144 is greater than or equal to four times a thermocouple probe diameter 410 (shown referring to FIG. 4). Merely for illustration, first thermocouple probe separation distance 142 and second thermocouple probe separation distance 144 may be selected as approximately 20 mm when thermocouple probe diameter 410 is selected as 5 mm.

First thermocouple probe 106, second thermocouple probe 108, and third thermocouple probe 110 are selected to each have a different surface emissivity on outer surface 400. For example, outer surface 400 of first thermocouple probe 106 may be blackened to have an emissivity greater than or equal to 0.75. Outer surface 400 of second thermocouple probe 108 may be polished to have an emissivity less than or equal to 0.25. Outer surface 400 of third thermocouple probe 110 may be roughened, for example, by sandblasting, to have an emissivity less than 0.75 and greater than 0.25. For example, outer surface 400 of third thermocouple probe 110 may have an emissivity less than 0.6 and greater than 0.4. As a result, a first emissivity of one of the plurality of thermocouple probes has a low emissivity; a second emissivity of one of the plurality of thermocouple probes has a high emissivity; and a third emissivity of one of the plurality of thermocouple probes has an intermediate emissivity. Emissivity is the measure of an object's ability to emit infrared energy and may be defined as a radiant exitance of a surface divided by that of a black body at the same temperature as that surface. Emitted energy indicates the temperature of the object. Emissivity can have a value from 0 (shiny mirror) to 1.0 (black body).

Though in the illustrative embodiment of FIGS. 1 to 3, third thermocouple probe 110 is similar to first thermocouple probe 106 and second thermocouple probe 108 in that it has a similar size and shape though a different emissivity, in an alternative embodiment, third thermocouple probe 110 may be thin wire thermocouple configured to measure an air temperature instead of a temperature of the hollow cylinder. In the alternative embodiment, outer surface 400 of first thermocouple probe 106 may be blackened to have an emissivity greater than or equal to 0.75, and outer surface 400 of second thermocouple probe 108 may be polished to have an emissivity less than or equal to 0.25. When used, the thin wire thermocouple to measure the air temperature may be mounted anywhere on an exterior of support body 104.

Figure 5:
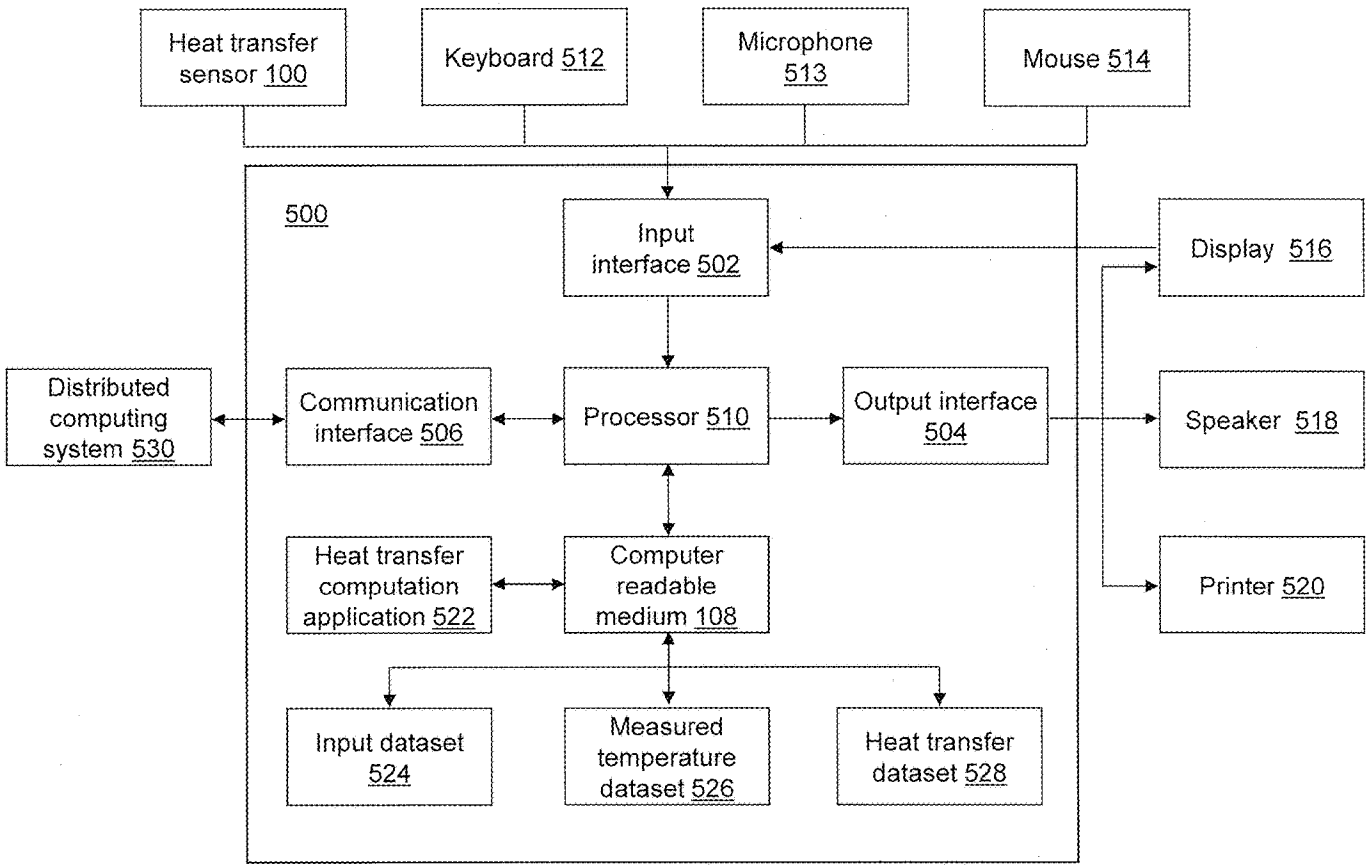
FIG. 5 depicts a block diagram of a heat transfer computation device in accordance with an illustrative embodiment.

Referring to FIG. 5, a block diagram of a heat transfer computation device 500 is shown in accordance with an illustrative embodiment. Heat transfer computation device 500 may include an input interface 502, an output interface 504, a communication interface 506, a non-transitory computer-readable medium 508, a processor 510, a heat transfer computation application 522, an input dataset 524, a measured temperature dataset 526, and heat transfer dataset 528. Fewer, different, and/or additional components may be incorporated into heat transfer computation device 500.

Input interface 502 provides an interface for receiving information from the user or another device for entry into heat transfer computation device 500 as understood by those skilled in the art. Input interface 502 may interface with various input technologies including, but not limited to, heat transfer sensor 100, a keyboard 512, a microphone 513, a mouse 514, a display 516, a track ball, a keypad, one or more buttons, etc. to allow information to be entered into heat transfer computation device 500 or to allow a user to make selections presented in a user interface displayed on display 516. The same interface may support both input interface 502 and output interface 504. For example, display 516 comprising a touch screen provides a mechanism for user input and for presentation of output to the user. Heat transfer computation device 500 may include one or more input interfaces that use the same or a different input interface technology. The input interface technology further may be accessible by heat transfer computation device 500 through communication interface 506.

Output interface 504 provides an interface for outputting information for review by a user of heat transfer computation device 500 and/or for use by another application or device. For example, output interface 504 may interface with various output technologies including, but not limited to, display 516, a speaker 518, a printer 520, etc. Heat transfer computation device 500 may include one or more output interfaces that use the same or a different output interface technology. The output interface technology further may be accessible by heat transfer computation device 500 through communication interface 506.

Communication interface 506 provides an interface for receiving and transmitting data between devices using various protocols, transmission technologies, and media as understood by those skilled in the art. Communication interface 506 may support communication using various transmission media that may be wired and/or wireless. Heat transfer computation device 500 may have one or more communication interfaces that use the same or a different communication interface technology. For example, heat transfer computation device 500 may support communication using an Ethernet port, a Bluetooth antenna, a telephone jack, a USB port, etc. Data and messages may be transferred between heat transfer computation device 500 and distributed computing system 530 using communication interface 506. In another embodiment, heat transfer sensor 100 may connect to heat transfer computation device 500 through communication interface 506 instead of through input interface 502.

Computer-readable medium 508 is an electronic holding place or storage for information so the information can be accessed by processor 510 as understood by those skilled in the art. Computer-readable medium 508 can include, but is not limited to, any type of random access memory (RAM), any type of read only memory (ROM), any type of flash memory, etc. such as magnetic storage devices (e.g., hard disk, floppy disk, magnetic strips, . . . ), optical disks (e.g., compact disc (CD), digital versatile disc (DVD), . . . ), smart cards, flash memory devices, etc. Heat transfer computation device 500 may have one or more computer-readable media that use the same or a different memory media technology. For example, computer-readable medium 508 may include different types of computer-readable media that may be organized hierarchically to provide efficient access to the data stored therein as understood by a person of skill in the art. As an example, a cache may be implemented in a smaller, faster memory that stores copies of data from the most frequently/recently accessed main memory locations to reduce an access latency. Heat transfer computation device 500 also may include one or more drives that support the loading of a memory media such as a CD, DVD, an external hard drive, etc. One or more external hard drives further may be connected to heat transfer computation device 500 using communication interface 506.

Processor 510 executes instructions as understood by those skilled in the art. The instructions may be carried out by a special purpose computer, logic circuits, or hardware circuits. Processor 510 may be implemented in hardware and/or firmware. Processor 510 executes an instruction, meaning it performs/controls the operations called for by that instruction. The term "execution" is the process of running an application or the carrying out of the operation called for by an instruction. The instructions may be written using one or more programming language, scripting language, assembly language, etc. Processor 510 operably couples with input interface 502, with output interface 504, with communication interface 506, and with computer-readable medium 508 to receive, to send, and to process information. Processor 510 may retrieve a set of instructions from a permanent memory device and copy the instructions in an executable form to a temporary memory device that is generally some form of RAM. Heat transfer computation device 500 may include a plurality of processors that use the same or a different processing technology.

Heat transfer computation application 522 performs operations associated with defining heat transfer dataset 528 from data stored in input dataset 524 and in measured temperature dataset 526. Referring to the example embodiment of FIG. 5, heat transfer computation application 522 is implemented in software (comprised of computer-readable and/or computer-executable instructions) stored in computer-readable medium 508 and accessible by processor 510 for execution of the instructions that embody the operations of heat transfer computation application 522. Heat transfer computation application 522 may be written using one or more programming languages, assembly languages, scripting languages, etc. Heat transfer computation application 522 may be integrated with other analytic tools.

Heat transfer computation application 522 may be used to log temperature data generated from measurements taken by first thermocouple probe 106, second thermocouple probe 108, and third thermocouple probe 110 as a function of time. Heat transfer computation application 522 further may compute parameters stored in heat transfer dataset 528. The operations of heat transfer computation application 522 may be distributed into one or more applications that may be executed independently on the same or different computing device including on distributed computing system 53.

Heat transfer dataset 528, input dataset 524, and measured temperature dataset 526 may be stored using one or more of various data structures as known to those skilled in the art including one or more files of a file system, a relational database, one or more tables of a system of tables, a structured query language database, etc. on heat transfer computation device 500 or on distributed computing system 530.

Figure 6:
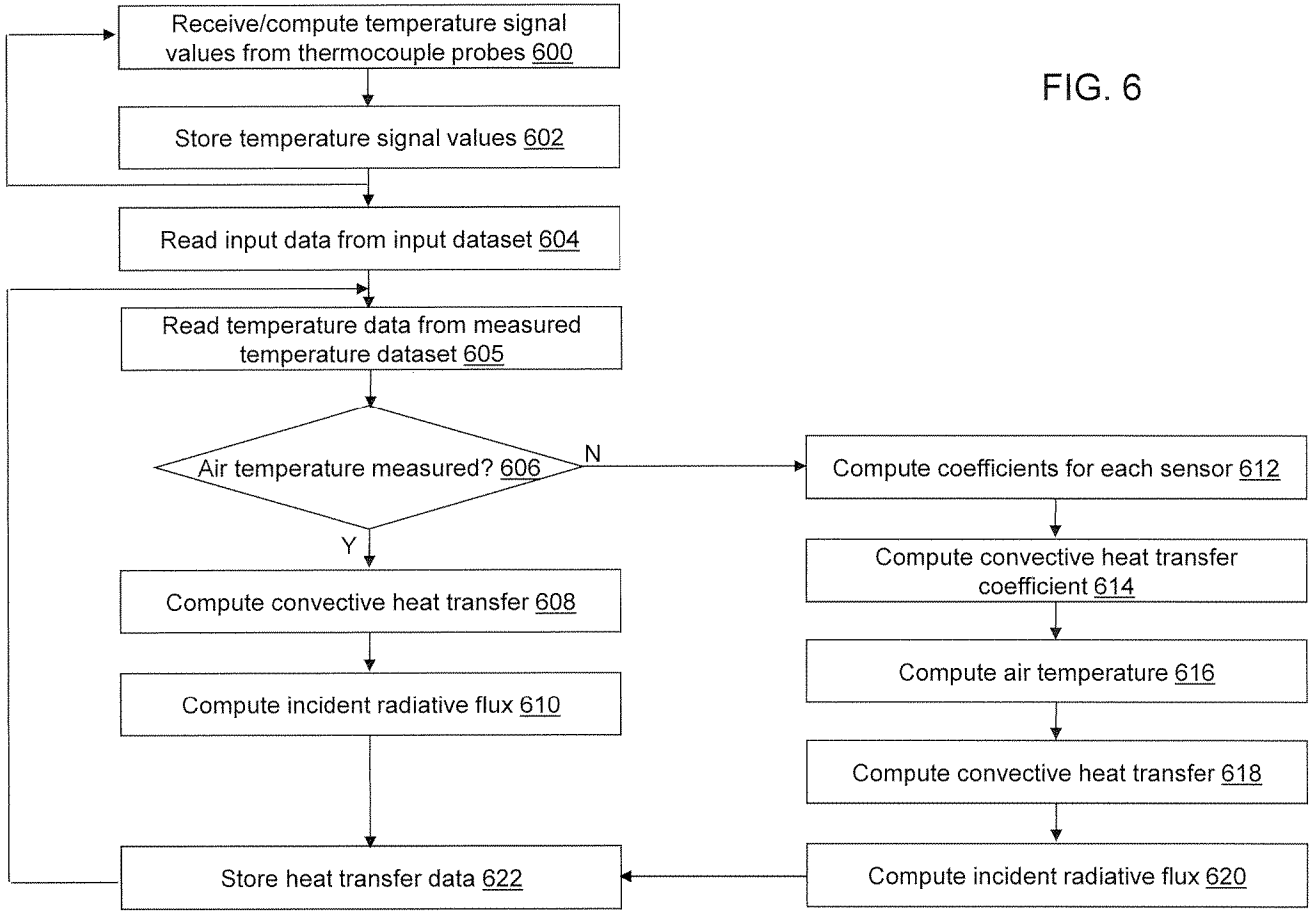
FIG. 6 depicts a flow diagram illustrating examples of operations performed by the heat transfer computation device of FIG. 5 in accordance with an illustrative embodiment.

Referring to FIG. 6, example operations associated with heat transfer computation application 522 are described. Additional, fewer, or different operations may be performed depending on the embodiment of heat transfer computation application 522. The order of presentation of the operations of FIG. 6 is not intended to be limiting. Although some of the operational flows are presented in sequence, the various operations may be performed in various repetitions, concurrently (in parallel, for example, using threads and/or distributed computing system 530), and/or in other orders than those that are illustrated. For example, a user may execute heat transfer computation application 522, which causes presentation of a first user interface window, which may include a plurality of menus and selectors such as drop down menus, buttons, text boxes, hyperlinks, etc. associated with heat transfer computation application 522 as understood by a person of skill in the art. The plurality of menus and selectors may be accessed in various orders. An indicator may indicate one or more user selections from a user interface, one or more data entries into a data field of the user interface, one or more data items read from computer-readable medium 508 or otherwise defined with one or more default values, etc. that are received as an input by heat transfer computation application 522. Again, the operations of heat transfer computation application 522 further may be distributed across a plurality of applications that execute at the same or different computing devices.

In an operation 600, a temperature signal value is received from the plurality of thermocouple probes 102. As another option, voltage values may be received through first thermocouple lead wire 300, second thermocouple lead wire 302, and third thermocouple lead wire 304 that are converted to temperature signal values. $T_{wire_1}$ may reference a first temperature signal value received from first thermocouple lead wire 300 or computed from a first voltage value received from first thermocouple lead wire 300. $T_{wire_2}$ may reference a second temperature signal value received from second thermocouple lead wire 302 or computed from a second voltage value received from second thermocouple lead wire 302. $T_{wire_3}$ may reference a third temperature signal value received from third thermocouple lead wire 304 or computed from a third voltage value received from third thermocouple lead wire 304. $T_{wire_1}$, $T_{wire_2}$, and $T_{wire_3}$ measure a temperature of the hollow cylinder to which the thermocouple(s) are mounted. When a plurality of thermocouples is mounted to a single thermocouple probe, $T_{wire_1}$, $T_{wire_2}$, and $T_{wire_3}$ are an average of the temperatures measured by each thermocouple.

As stated previously, in an alternative embodiment, third thermocouple probe 110 may instead directly measure the air temperature $T_{Air}$ that surrounds heat transfer sensor 100 such that the voltage received through third thermocouple lead wire 304 is converted to the air temperature $T_{Air}$. To measure $T_{Air}$ directly, third thermocouple probe 110 may be formed using a fine wire thermocouple, a thermistor, etc. In a preferred embodiment, $T_{Air}$ may be measured directly unless this cannot easily be accomplished using a thermocouple.

In an operation 602, the received and/or converted temperature signal values that may include $T_{wire_1}$, $T_{wire_2}$, and $T_{wire_3}$ or may include $T_{wire_1}$, $T_{wire_2}$, and $T_{Air}$ are stored in measured temperature dataset 526 of computer-readable medium 508. In an illustrative embodiment, heat transfer computation application 522 that is integrated into heat transfer sensor 100 is a data logger that stores temperature signal values as a function of time as a wildfire burns around heat transfer sensor 100. The remaining operations 604 to 622 may be performed when heat transfer sensor 100 is collected after the wildfire is no longer in a vicinity of heat transfer sensor 100. As another option, the remaining operations 604 to 622 may be performed by heat transfer sensor 100 as the temperature data is stored.

Operations 604 to 622 of heat transfer computation application 522 compute an estimate of a convective flux and a radiative flux for a fuel bed in front of a wildland fire. The general principle behind heat transfer sensor 100 is use of similarly shaped metal objects that each have a different emissivity. First thermocouple probe 106, second thermocouple probe 108, and/or third thermocouple probe 110 are selected to have a similar shape to fuel particles of the fuel bed (shape and size). In the illustrative embodiment, grasses, twigs, and pine needles were the selected fuel particles so first thermocouple probe 106, second thermocouple probe 108, and/or third thermocouple probe 110 were chosen as cylinders to represent the shapes of grasses, twigs, and pine needles. As a result, in the illustrative embodiment, first thermocouple probe 106, second thermocouple probe 108, and/or third thermocouple probe 110 may be implemented using wires or metal hollow thermocouple probes as discussed previously. The similarity in the shape means that the convective heat transfer coefficient is similar for first thermocouple probe 106, second thermocouple probe 108, and/or third thermocouple probe 110 assuming each is exposed to the same air velocity; whereas, the radiative heating is different between first thermocouple probe 106, second thermocouple probe 108, and/or third thermocouple probe 110. By measuring the temperature from each of first thermocouple probe 106, second thermocouple probe 108, and/or third thermocouple probe 110, incident radiation and convective heat transfer can be separated when the local air temperature $T_{Air}$ is known. As stated previously, third thermocouple probe 110 may measure $T_{wire_3}$ or $T_{Air}$ directly.

In an operation 604, input data is read from input dataset 524. Illustrative input data includes the dimensions and emissivity values of the plurality of thermocouple probes 102. Illustrative input data includes, $c_p$ a specific heat, $m_1$ a mass of first thermocouple probe 106, $m_2$ a mass of second thermocouple probe 108, $m_3$ a mass of third thermocouple probe 110, $A_{wire_1}$ a surface area of outer surface 400 of first thermocouple probe 106, $A_{wire_2}$ a surface area of outer surface 400 of second thermocouple probe 108, $A_{wire_3}$ a surface area of outer surface 400 of third thermocouple probe 110, σ Stefan-Boltzmann constant equal to $5.67\times10^{-8}$ Watts/(meters$^2$Kelvin$^4$), $\epsilon_{wire_1}$ an emissivity of first thermocouple probe 106, $\epsilon_{wire_2}$ an emissivity of second thermocouple probe 108, and $\epsilon_{wire_3}$ an emissivity of third thermocouple probe 110. In an illustrative embodiment, $m_1=m_2=m_3$ and $A_{wire_1}=A_{wire_2}=A_{wire_3}$.

In an operation 605, $T_{wire_1}$, $T_{wire_2}$, and $T_{wire_3}$ or $T_{wire_1}$ $T_{wire_2}$, and $T_{Air}$ are read from measured temperature dataset 526.

In an operation 606, a determination is made concerning whether or not third thermocouple probe 110 measures $T_{wire_3}$ or $T_{Air}$. When third thermocouple probe 110 measures $T_{Air}$, processing continues in operation 610. When third thermocouple probe 110 measures $T_{wire_3}$, processing continues in an operation 612. Of course, an actual decision point may not be implemented by heat transfer computation application 522 because one or the other set of operations is implemented automatically based on the configuration of heat transfer sensor 100.

In operation 608, a convective heat transfer is computed as $C=h(T_{Air}-T_{fuel})$, where C is the convective heat transfer expressed as a flux, h is a convective heat transfer coefficient, and $T_{fuel}$ is a fuel temperature. The convective heat transfer coefficient may be computed using the following equation:

$$h=\left[\frac{1}{T_{Air}\left(1-\frac{\epsilon_{wire_2}}{\epsilon_{wire_1}}\right)-T_{wire_2}+T_{wire_1}\frac{\epsilon_{wire_2}}{\epsilon_{wire_1}}}\right]*\left[\frac{c_p m_2}{A_{wire_2}}\frac{\partial T_{wire_2}}{\partial t}+\sigma\epsilon_{wire_2}T_{wire_2}^4-\left(\frac{c_p m_1}{A_{wire_1}}\frac{\partial T_{wire_1}}{\partial t}+\sigma\epsilon_{wire_1}T_{wire_1}^4\right)\frac{\epsilon_{wire_2}}{\epsilon_{wire_1}}\right]$$

In an operation 610, an incident radiative flux E may be computed using the following equation, and processing continues in operation 622:

$$E=\frac{\frac{c_p m_1}{A_{wire_1}}\frac{\partial T_{wire_1}}{\partial t}+\sigma\epsilon_{wire_1}T_{wire_1}^4-h(T_{Air}-T_{wire_1})}{\epsilon_{wire_1}}$$

where $$\frac{\partial T_{wire_i}}{\partial t}$$

is approximated as $$\frac{\partial T_{wire}}{\partial t}=\frac{T_{wire}(t+\Delta t)-T_{wire}(t)}{\Delta t}$$

(zero for steady state) by comparing $T_{wire_1}$ and $T_{wire_2}$ for consecutive times.

In operation 612, coefficients for first thermocouple probe 106, second thermocouple probe 108, and third thermocouple probe 110 are computed using the following equations (derived below):

$$D_i=\frac{c_p m_i}{A_{wire_i}}\frac{\partial T_{wire_i}}{\partial t}+\sigma\epsilon_{wire_i}T_{wire_i}^4$$

$$F_i=\epsilon_{wire_i}$$

$$G_i=T_{wire_i}$$

where i=1, 2, 3.

In an operation 614, convective heat transfer coefficient h is computed using the following equation:

$$h=\frac{[(D_3-D_1)(F_2-F_1)+(F_1-F_3)(D_2-D_1)]}{[(F_3-F_1)(G_2-G_1)+(G_1-G_3)(F_2-F_1)]}$$

In an operation 616, the air temperature $T_{Air}$ is computed using the following equation:

$$T_{Air}=\frac{D_1}{h}-\left(\frac{F_1[D_2-D_1]}{h(F_2-F_1)}\right)-\left(\frac{F_1[G_2-G_1]}{(F_2-F_1)}\right)+G_1$$

In an operation 618, the convective heat transfer coefficient C is computed using $C=h(T_{Air}-T_{fuel})$.

In an operation 620, the incident radiative flux E may be computed using the following equation, and processing continues in operation 622:

$$E=\frac{[D_2-D_1+h(G_2-G_1)]}{(E_2-E_1)}$$

In an operation 622, the computed heat transfer data that may include the convective heat transfer C, the convective heat transfer coefficient h, and/or the incident radiative flux E are stored in heat transfer dataset 528 of computer-readable medium 508. Processing continues in operation 605 to read the temperature data measured at the next time step. In an alternative embodiment, processing may continue in operation 600 to instead receive the temperature data at the next time step.

Prior to ignition, the time rate of change in temperature of a fuel element exposed to wildland fire can be largely described by the equation:

$$\frac{\partial T_{wire}c_p m_{fuel}}{\partial t}=EA\epsilon_{fuel}-\sigma A\epsilon_{fuel}T_{fuel}^4+hA(T_{Air}-T_{fuel})+\frac{\partial}{\partial x_i}\left[K\frac{\partial T}{\partial x_i}\right]$$

where $x_i$ are orthogonal spatial directions within the fuel elements. For the purpose of model development, assumptions are often made concerning the relative magnitude of these terms. For example, $B_{it}=hl/4k$, where l is a volume per surface area of the fuel particle, and k is a thermal conductivity of the fuel element. $B_{it}$ is a dimensionless number relating internal thermal resistance to the thermal resistance at the surface of the fuel element and may be used to suggest a relative magnitude of the convective and conduction heat transfer from a location on the fuel element. When this number is large, the fuel element can be considered thermally thin because the thermal conductivity is sufficiently strong over the thickness of the fuel element compared to the convective heat transfer over the surface area such that it can be all be treated as one temperature when considering heating and cooling of the surface. For example, grass might have a volume per surface area per unit volume of 0.00025 meters (m) and a thermal conductivity of 0.12 Watts/m/Kelvin exposed to a 1 m/second wind resulting in $B_{it}=0.0015$ assuming standard atmospheric conditions (i.e., a specific heat capacity and density of 1004 Joules/kilogram (kg)/Kelvin and 1.225 kg/m$^3$, respectively).

The energy balance for first thermocouple probe 106, second thermocouple probe 108, and/or third thermocouple probe 110 may be given by the following equation if it is assumed that first thermocouple probe 106, second thermocouple probe 108, and/or third thermocouple probe 110 act as a grey body and ignore any conduction into the ground:

$$\frac{\partial T_{wire}c_p m}{\partial t}=EA_{wire}\epsilon_{wire}-\sigma A\epsilon_{wire}T_{wire}^4+hA(T_{Air}-T_{wire})$$

If it is assumed that $T_{Air}$, E, and h are the same for first thermocouple probe 106, second thermocouple probe 108, and/or third thermocouple probe 110 based on their proximity to one another and no interaction between them, the following two equations can be written for first thermocouple probe 106 and second thermocouple probe 108:

$$\frac{c_p m_1}{A_{wire_1}} \frac{\partial T_{wire_1}}{\partial t} = E\epsilon_{wire_1} - \sigma\epsilon_{wire_1} T_{wire_1}^4 + h(T_{Air} - T_{wire_1})$$

$$\frac{c_p m_2}{A_{wire_2}} \frac{\partial T_{wire_2}}{\partial t} = E\epsilon_{wire_2} - \sigma\epsilon_{wire_2} T_{wire_2}^4 + h(T_{Air} - T_{wire_2})$$

Unfortunately, $T_{Air}$ remains in these equations. There are a number of ways to compute $T_{Air}$. The easiest way is to measure $T_{Air}$ directly using third thermocouple probe 110 in the vicinity of first thermocouple probe 106 and second thermocouple probe 108. For example, this can be done with a very fine wire thermocouple where the convective heat exchange keeps the thermocouple at the same temperature as the air around it as discussed previously. Another method is to use third thermocouple probe 110.

$$\frac{c_p m_1}{A_{wire_1}} \frac{\partial T_{wire_1}}{\partial t} = E\epsilon_{wire_1} - \sigma\epsilon_{wire_1} T_{wire_1}^4 + h(T_{Air} - T_{wire_1})$$

$$\frac{c_p m_2}{A_{wire_2}} \frac{\partial T_{wire_2}}{\partial t} = E\epsilon_{wire_2} - \sigma\epsilon_{wire_2} T_{wire_2}^4 + h(T_{Air} - T_{wire_2})$$

$$\frac{c_p m_3}{A_{wire_3}} \frac{\partial T_{wire_3}}{\partial t} = E\epsilon_{wire_3} - \sigma\epsilon_{wire_3} T_{wire_3}^4 + h(T_{Air} - T_{wire_3})$$

Simplifying results in the following computations:

$$D_1 = EF_1 + hT_{Air} - hG_1$$

$$D_2 = EF_2 + hT_{Air} - hG_2$$

$$D_3 = EF_3 + hT_{Air} - hG_3$$

Solving $$hT_{Air} = D_1 - EF_1 + hG_1$$

$$T_{Air} = \frac{D_1}{h} - \frac{E}{h}F_1 + G_1$$

$$E = \frac{D_2}{F_2} - \frac{hT_{Air}}{F_2} + \frac{hG_2}{F_2}$$

substituting to remove the unknown values, and back solving for the unknown values results in the equations used to solve for h in operation 614, $T_{Air}$ in operation 616, and E in operation 620.

Given a set of three thermocouple probes or wires of the same size, the convective heat transfer to fuel elements of larger or smaller size fuel elements can be determined by adding a single thermocouple probe or wire of the desired size and the same emissivity as one of first thermocouple probe 106, second thermocouple probe 108, and/or third thermocouple probe 110. Since the radiative flux and $T_{Air}$ are assumed to be the same in the vicinity of the thermocouple probes that are close to each other, but not influencing the heat transfer to one another, the difference in temperature between the sensor of the new size and the original sensor of the same emissivity is directly tied to the convective heat transfer coefficient and area of the new wire. Thus, heat transfer sensor 100 and heat transfer computation application 522 can be used to estimate the heat transfer modes for a range of size of fuel elements.

A prototype heat transfer sensor 100 included three commercially available 316 stainless steel ⅛ inch diameter, 6 inch long type K thermocouple probes sold by Omega Engineering that were modified by altering their surfaces to change their emissivity. The probes themselves had three thermocouple junctions welded to the inside of the tip, 3 inches and 6 inches below the tip of the stainless steel tube (hollow cylinder). The temperatures measured by the three thermocouples were averaged. In addition, a shorter probe (6 inches) of similar design to the profile probe describe above, but with only a single thermocouple welded to the inside of the tip was also tested. For the three-sensor solution described above, one thermocouple was coated in high temperature flat black paint (Rust-Oleum's High-Heat flat black spray paint, SKU 7778830), another was pneumatically blasted with 80 grit silicon carbide abrasive to create a matte finish, and a third was polished with 000 steel wool and liquid metal polish. For the two-sensor configuration, only the black and polished sensors were used. Emissivities were as follows: the painted sensor had an emissivity of 0.88, the sensor with the matte finish had an emissivity of 0.56, and the polished sensor had an emissivity of 0.16. Each sensor was measured with a data logger at one hertz. Any data logging device capable of measuring type K thermocouples could be used. Other thermocouple probe configurations may have 3/16 inch and ¼ inch diameters with a similar configuration to the probes above. As stated previously, larger diameter probes (e.g., 1 inch and 3 inch diameters) may use additional thermocouples placed at 60 degree intervals around the circumference of the probe, but designed as described above. The sensor signals may be transferred to protected data loggers using protected cables or wirelessly.

Heat transfer sensor 100 provides the empirical determination of the relative contribution of radiative and convective heating of fuel elements in wildland fires and the evolution of these quantities as the fire approaches. This information is critical for understanding how wildland fire spreads. Deploying thermocouple probes with different emissivities provides sufficient data for differentiating the relative forms of heat transfer. The cost of heat transfer sensor 100 is low enough to allow deployment at numerous locations in front of a fire, and thus, allow assessment of the spatial heterogeneity of these heating mechanisms.

Heat transfer sensor 100 further can be rapidly placed or staked to the ground. Heat transfer sensor 100 further can be placed in tree canopies to study the heat transfer to crown fuels. Heat transfer sensor 100 provides a rapid and an inexpensive collection of empirical data on transient and heterogeneous fuel heating in front of a wildfire.

Heat transfer sensor 100 provides a cost savings making it feasible to collect convective and radiative heating information in a wide variety of wildfire and prescribed fire conditions by private, government and academic institutions. This provides essential data for the development of new models, new fire management strategies, new fire protection engineering guidelines, etc. Numerous heat transfer sensors 100 may be deployed on the same fires in different locations on the surface and in the tree crown to capture estimates of the full range of the heterogeneous heating that occurs in these fires.

Heat transfer sensor 100 relies on varying the emissivity of hollow stainless steel thermocouple probes or wires of varying diameters and measuring their temperature with a thermocouple welded to the interior surface of the thermocouple probe or imbedded inside the wire. The choice of hollow thermocouple probes or wires can be made depending on the size and shape of the fuel elements that they are intended to represent. Applying the laws of conservation of energy to the different thermocouple probes allows the calculation of the proportion of heating due to convective heat transfer from hot gases and the proportion due to impingement of thermal radiation. Two different versions of the methodology are posed: 1) two thermocouple probes with low and high emissivity and direct measurement of the air temperature, and 2) three thermocouple probes with low, moderate, and high emissivity. In both designs, the thermocouple probes are placed in close proximity and their temperatures are recorded by microprocessor or data logger and used to compute the incident radiation and convective heat transfer as described above. Local velocity can also be estimated through this methodology. By varying the diameter of the thermocouple probes, the impact of fuel size on the relative role of convective versus radiative heating can be examined.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A heat transfer sensor comprising:

a support body comprising a top wall and a plurality of side walls;

a first thermocouple probe mounted to the top wall to extend upright relative to an exterior surface of the top wall, the first thermocouple probe comprising a first hollow cylinder configured to have a first emissivity that is less than or equal to 0.25;

a first thermocouple mounted to an interior of the first hollow cylinder and configured to generate a first voltage based on a first temperature of the first hollow cylinder; and a first insulator mounted between the first hollow cylinder and the top wall;

a second thermocouple probe mounted to the top wall to extend upright relative to the exterior surface of the top wall, the second thermocouple probe comprising a second hollow cylinder configured to have a second emissivity that is greater than or equal to 0.75;

a second thermocouple mounted to an interior of the second hollow cylinder and configured to generate a second voltage based on a second temperature of the second hollow cylinder; and a second insulator mounted between the second hollow cylinder and the top wall;

a third thermocouple probe mounted to the top wall to extend upright relative to the exterior surface of the top wall, the third thermocouple probe comprising a third hollow cylinder configured to have a third emissivity that is greater than 0.25 and less than 0.75;

a third thermocouple mounted to an interior of the third hollow cylinder and configured to generate a third voltage based on a third temperature of the third hollow cylinder; and a third insulator mounted between the third hollow cylinder and the top wall;

a processor; and a non-transitory computer-readable medium operably coupled to the processor, the computer-readable medium having computer-readable instructions stored thereon that, when executed by the processor, cause the heat transfer sensor to receive the first voltage from the first thermocouple probe;

receive the second voltage from the second thermocouple probe;

receive the third voltage from the third thermocouple probe;

convert the first voltage to a first temperature value;

convert the second voltage to a second temperature value;

convert the third voltage to a third temperature value; and compute a convective heat transfer to and an incident radiation on an object in an environment surrounding the support body using the first temperature value, the second temperature value, and the third temperature value, wherein an area of the first hollow cylinder computed using a diameter and a height of the first hollow cylinder is approximately equal to an area of the object in the environment for which the heat transfer sensor computes the convective heat transfer and the incident radiation.

2. The heat transfer sensor of claim 1, wherein an air temperature is computed using the first temperature value, the second temperature value, and the third temperature value, wherein the convective heat transfer and the incident radiation are further computed using the computed air temperature.

3. The heat transfer sensor of claim 1, wherein the first thermocouple probe comprises a first plurality of thermocouples, wherein the first thermocouple is one of the first plurality of thermocouples, wherein the first plurality of thermocouples are circumferentially spaced around the interior of the first hollow cylinder.

4. The heat transfer sensor of claim 3, wherein the first plurality of thermocouples are evenly spaced around the interior of the first hollow cylinder.

5. The heat transfer sensor of claim 3, wherein the second thermocouple probe comprises a second plurality of thermocouples, wherein the second thermocouple is one of the second plurality of thermocouples, wherein the second plurality of thermocouples are circumferentially spaced around the interior of the second hollow cylinder.

6. The heat transfer sensor of claim 1, wherein the first thermocouple probe comprises a first plurality of thermocouples, wherein the first thermocouple is one of the first plurality of thermocouples, wherein at least two thermocouples of the first plurality of thermocouples are spaced at different heights within the interior of the first hollow cylinder.

7. The heat transfer sensor of claim 6, wherein at least two thermocouples of the first plurality of thermocouples are circumferentially spaced around the interior of the first hollow cylinder.

8. The heat transfer sensor of claim 1, wherein the first thermocouple is mounted a distance below a tip of the first hollow cylinder opposite the top wall, wherein the distance is at least five times an interior diameter of the first hollow cylinder.

9. The heat transfer sensor of claim 1, wherein a distance between the first thermocouple probe and the second thermocouple probe is greater than or equal to four times an interior diameter of the first hollow cylinder.

10. The heat transfer sensor of claim 1, wherein the height of the first hollow cylinder is approximately equal to a second height of the second hollow cylinder.

11. The heat transfer sensor of claim 10, wherein the diameter of the first hollow cylinder is approximately equal to a second diameter of the second hollow cylinder.

12. The heat transfer sensor of claim 1, wherein a first hollow cylinder portion of the first hollow cylinder that extends above the exterior surface of the top wall is formed of a solid wall.

13. The heat transfer sensor of claim 1, wherein the first thermocouple is mounted a first distance from a first thermocouple probe top surface that is opposite the top wall of the support body, wherein the second thermocouple is mounted a second distance from a second thermocouple probe top surface that is opposite the top wall of the support body, wherein the third thermocouple is mounted a third distance from a third thermocouple probe top surface that is opposite the top wall of the support body, wherein the first distance is equal to the second distance and to the third distance.

14. The heat transfer sensor of claim 1, wherein an exterior of the third hollow cylinder has a matte finish, and the third emissivity is greater than 0.4 and less than 0.6.

15. A heat transfer sensor comprising:

a support body comprising a top wall and a plurality of side walls;

a first thermocouple probe mounted to the top wall to extend upright relative to an exterior surface of the top wall, the first thermocouple probe comprising a first hollow cylinder configured to have a first emissivity that is less than or equal to 0.25;

a first thermocouple mounted to an interior of the first hollow cylinder and configured to generate a first voltage based on a first temperature of the first hollow cylinder; and a first insulator mounted between the first hollow cylinder and the top wall;

a second thermocouple probe mounted to the top wall to extend upright relative to the exterior surface of the top wall, the second thermocouple probe comprising a second hollow cylinder configured to have a second emissivity that is greater than or equal to 0.75;

a second thermocouple mounted to an interior of the second hollow cylinder and configured to generate a second voltage based on a second temperature of the second hollow cylinder; and a second insulator mounted between the second hollow cylinder and the top wall;

a third thermocouple probe mounted to the top wall to measure a value of an air temperature of an environment surrounding the support body;

a processor; and a non-transitory computer-readable medium operably coupled to the processor, the computer-readable medium having computer-readable instructions stored thereon that, when executed by the processor, cause the heat transfer sensor to receive the first voltage from the first thermocouple probe;

receive the second voltage from the second thermocouple probe;

receive the measured value of the air temperature from the third thermocouple probe;

convert the first voltage to a first temperature value;

convert the second voltage to a second temperature value; and compute a convective heat transfer to and an incident radiation on an object in the environment surrounding the support body using the first temperature value, the second temperature value, and the received, measured value of the air temperature, wherein an area of the first hollow cylinder computed using a diameter and a height of the first hollow cylinder is approximately equal to an area of the object in the environment for which the heat transfer sensor computes the convective heat transfer and the incident radiation.

16. The heat transfer sensor of claim 15, wherein the third thermocouple probe is a thermistor.

17. The heat transfer sensor of claim 15, wherein a first hollow cylinder portion of the first hollow cylinder that extends above the exterior surface of the top wall is formed of a solid wall.

18. The heat transfer sensor of claim 15, wherein the first thermocouple is mounted a first distance from a first thermocouple probe top surface that is opposite the top wall of the support body, wherein the second thermocouple is mounted a second distance from a second thermocouple probe top surface that is opposite the top wall of the support body, wherein the third thermocouple is mounted a third distance from a third thermocouple probe top surface that is opposite the top wall of the support body, wherein the first distance is equal to the second distance and to the third distance.

* * * * *